US008933330B2

(12) United States Patent
Hayashishita et al.

(10) Patent No.: US 8,933,330 B2
(45) Date of Patent: Jan. 13, 2015

(54) COAXIAL CABLE AND METHOD OF MAKING THE SAME

(75) Inventors: Tatsunori Hayashishita, Hachinohe (JP); Hirokazu Takahashi, Hachinohe (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 801 days.

(21) Appl. No.: 12/699,555

(22) Filed: Feb. 3, 2010

(65) Prior Publication Data

US 2010/0212933 A1 Aug. 26, 2010

(30) Foreign Application Priority Data

Feb. 26, 2009 (JP) ..... 2009-044144

(51) Int. Cl.
*H01B 11/18* (2006.01)

(52) U.S. Cl.
CPC ..... *H01B 11/1895* (2013.01); *H01B 11/1813* (2013.01)
USPC ..... 174/28

(58) Field of Classification Search
USPC ..... 174/110 R, 28
See application file for complete search history.

(56) References Cited

U.S. PATENT DOCUMENTS 6,756,538 B1 * 6/2004 Murga-Gonzalez et al. ... 174/28
2007/0187134 A1 8/2007 Detian et al.

FOREIGN PATENT DOCUMENTS

JP H01-168918 U 11/1989
JP 2007-169687 A 7/2007
JP 2007-172928 A 7/2007
JP 2007-242264 A 9/2007
JP 2008-027914 A 2/2008

OTHER PUBLICATIONS

Office Action of the corresponding Japanese Patent Application No. 2009-044144, dated Aug. 2, 2011.

* cited by examiner

*Primary Examiner* — Chau N Nguyen
(74) *Attorney, Agent, or Firm* — Global IP Counselors, LLP

(57) ABSTRACT

The present invention provides a small-diameter coaxial cable in which the same electrical and mechanical characteristics as in the prior art can be maintained and costs do not increase. The coaxial cable comprises a central conductor including three twisted wires and having a cross-sectional area of 0.005 $mm^2$ or less, a fluororesin insulation for covering the central conductor, an outer conductor disposed on the external periphery of the insulation, and a jacket for covering the outer conductor. The adhesive force between the central conductor and the insulation is one third or less the tensile strength of the central conductor. The method for manufacturing the coaxial cable comprises twisting three wires together to form a central conductor having a cross-sectional area of 0.005 $mm^2$ or less, extruding a fluororesin and forming an insulation on the central conductor so that adhesive force with the central conductor is one third or less the tensile strength of the central conductor, and providing the insulation with an outer conductor and a jacket.

2 Claims, 2 Drawing Sheets

COAXIAL CABLE AND METHOD OF MAKING THE SAME

BACKGROUND OF THE INVENTION

1. Technical Field

The present invention relates to a coaxial cable comprising a central conductor, insulation, an outer conductor, and a jacket, and a method for manufacturing the same.

2. Related Background Art

Coaxial cables that are used in small communication devices, electronic equipment, medical equipment, and the like are typically formed as thin cables having an outside diameter of 0.5 mm or less, and there is a demand for further diameter reduction. The diameter of the central conductor, the thickness of the insulation layer, and the like are being made smaller in response to the demand for diameter reduction, but there is also a demand for better mechanical strength and bending resistance from the standpoint of ensuring reliability. With the increasing signal transmission speeds of recent years, there is also a demand for a coaxial cable having minimal signal attenuation. Reducing signal attenuation necessitates a reduction in the dielectric constant of the insulation that surrounds the central conductor.

JP2007-172928A (Patent Document 1) describes a coaxial cable in which the central conductor is obtained by twisting thin conductors (wires) together, and the silver content and the heat treatment of the central conductor are optimized in order to minimize the resulting reduction in the dielectric constant and tensile strength. The central conductor of this coaxial cable is a copper alloy containing 1 to 3 wt % silver, with the balance being substantially copper. The central conductor is obtained by twisting together seven wires having a diameter of 0.010 mm to 0.025 mm, and has a tensile strength of 850 MPa or greater, electrical resistivity of 85% or greater relative to a standard annealed copper conductor, and an insulation thickness of 0.07 mm or less.

JP2007-169687A (Patent Document 2) describes a coaxial cable which has the aforementioned central conductor and foam insulation such that the insulation has a reduced thickness and a reduced diameter and the cable maintains an electrostatic capacitance at a predetermined level or below.

JP2007-242264A (Patent Document 3) describes a coaxial cable in which the insulation surrounding the central conductor is formed as a non-foam solid layer, and in which electrical and mechanical characteristics are improved by creating voids between the surface of the central conductor and the insulation. Creating a spiral ridge on the central conductor is described as the method of creating the voids. Specifically, it is disclosed that the cable is formed from a double-twisted wire obtained by twisting together two or three twisted wires in which two or three conductor wires are themselves twisted together.

DISCLOSURE OF THE INVENTION

An object of the present invention is to provide a coaxial cable in which foam insulation is not used, in which the same electrical and mechanical characteristics can be maintained as in the prior art, and in which the cost does not increase, and to provide a method for manufacturing the same.

To achieve this object, there is provided a coaxial cable comprising a central conductor including three twisted wires and having a cross-sectional area of 0.005 $mm^2$ or less, a fluororesin insulation for covering the central conductor, an outer conductor disposed on the external periphery of the insulation, and a jacket for covering the outer conductor, wherein the adhesive force between the central conductor and the insulation is one third or less the tensile strength of the central conductor. The twist pitch of twisting the central conductor is preferably between 11 and 16 times the diameter of the central conductor. The central conductor is preferably a silver-copper alloy having a silver content of between 0.5 and 2.2 wt %.

According to another aspect of the invention, there is provided a method for manufacturing a coaxial cable comprising twisting three wires together to form a central conductor having a cross-sectional area of 0.005 $mm^2$ or less, extruding a fluororesin on the central conductor and forming an insulation so that the adhesive force with the central conductor is one third or less the tensile strength of the central conductor, and providing the insulation with an outer conductor and a jacket.

According to the present invention, it becomes possible to obtain the same electrical and mechanical characteristics as in the prior art while increasing productivity and reducing costs without the use of foam insulation.

DETAILED DESCRIPTION OF THE INVENTION

Figure 1A:
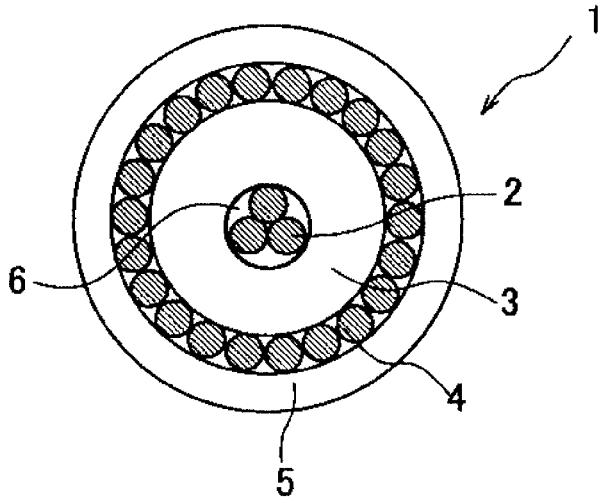
FIG. 1A is a cross-sectional view of a coaxial cable according to an embodiment of the present invention in a plane perpendicular to the longitudinal direction of the cable.

Coaxial cables need to be less expensive in addition to having even higher signal transmission speeds, reduced diameters, and enhanced bending resistance. However, the coaxial cable described in Patent Document 1 requires higher processing costs and is more expensive because of the reduced diameter of the wires constituting the central conductor, and the signals transmitted through the cable have a higher attenuation. In addition, the coaxial cable described in Patent Document 2 tends to have variable electrical characteristics, cannot easily be made thinner, has poor productivity, and is expensive because the insulation that surrounds the central conductor is formed from foam insulation. In Patent Document 3, the insulator is a non-foam material, and the central conductor is formed from double-twisted wires obtained by twisting multiple twisted wire pairs in which two conductor wires are themselves twisted together. A case in which a twisted wire pair, obtained by twisting together a pair of conductor wires, is used for the central conductor is also disclosed as a comparative example. None of the embodiments is able to provide sufficient voids, and the double-twisted wire requires double twisting and is therefore expensive.

Embodiments of the present invention are described below with reference to the drawings. The drawings are used for illustrative purposes only, and are not meant to limit the scope of the invention. In the drawings, the same symbols are assigned to the same members, and the corresponding descriptions are omitted. The proportions of the components in the drawings may be different from those of the actual items.

Figure 1B:
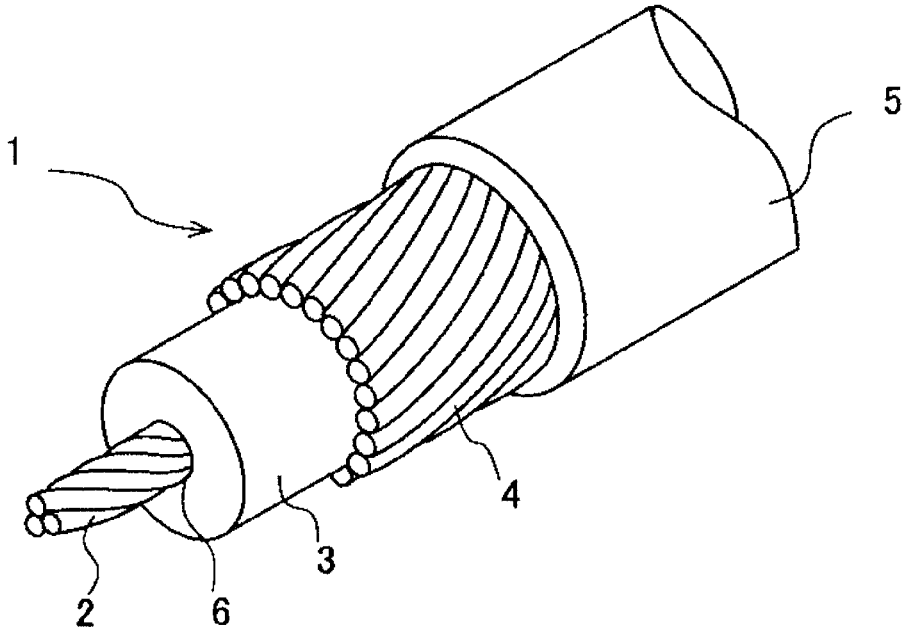
FIG. 1B is a perspective view of a terminal of the coaxial cable with the jacket removed.

FIG. 1A is a cross-sectional view of a coaxial cable 1 according to an embodiment of the present invention in a plane perpendicular to the longitudinal direction of the cable, and FIG. 1B is a perspective view of a terminal of the coaxial cable 1 with the jacket removed. The coaxial cable 1 is configured so that the outside of a central conductor 2 is surrounded by an insulation 3 having a low dielectric constant, the outside thereof is formed by the spiral shielding of an outer conductor 4, and the external surface of the outer conductor 4 is covered with a jacket 5. The diameter of the central conductor in a small-diameter (very thin) coaxial cable is usually reduced and the insulation made thinner in order to reduce the outside diameter of the cable. Small voids 6 are usually formed between the central conductor 2 and the insulation 3.

For example, single element, small-diameter twisted wires (the cross-sectional area of the central conductor is 0.005 $mm^2$ or less) that are equivalent to American Wire Gauge (AWG) #40 or greater may be used for the central conductor 2. In the depicted embodiment, shown in FIG. 1A and FIG. 1B, each of the wires in the central conductor 2 is a single strand or single element of solid wire. In other words, the wires of the central conductor are not composed of a plurality of strands of wires, but rather are each comprised of a single element, such that the three depicted single element wires are twisted together to define the central conductor 2. The insulation 3 is obtained by extrusion molding fluororesin to a thickness of approximately 0.06 mm or by wrapping the central conductor 2 with resin tape. The outer conductor 4 is obtained by the spiral shielding of a conductor having the same thickness as the wire conductors used in the central conductor 2. The jacket 5 is obtained by extrusion molding a resin layer onto the external surface of the outer conductor 4 to a thickness of approximately 0.03 mm, or by wrapping the outer conductor 4 with resin tape. The outside diameter of the coaxial cable is thus reduced to about 0.3 mm. It should be noted that small-diameter coaxial cables are often obtained by arranging a plurality of wires in parallel rows or bundling the plurality of wires into a circular cable shape and forming a multi-core cable.

In the coaxial cable 1, the cross-sectional area of the voids 6 created between the central conductor 2 and the insulation 3 is increased instead of using foam insulation for the insulation 3 in order to reduce the electrostatic capacitance (apparent dielectric constant of the insulation 3) between the central conductor 2 and the outer conductor 4. Signal attenuation is thereby reduced and the electrical characteristics (transmission performance) are improved.

In order to increase the volume of the voids between the central conductor 2 and the insulation 3, the number of twisted conductor wires is reduced from seven to three without changing the cross-sectional area of the central conductor 2. A stable concavo-convex cross section having a twisted shape is thereby formed on the external surface of the central conductor 2, and voids 6 sufficient in order to contribute to improving the electrical characteristics can be obtained. In addition, since the number of conductor wires is reduced without changing the cross-sectional area of the central conductor 2, it is possible to increase the diameter of each twisted conductor wire. There is accordingly an advantage in terms of cost. (Calculated in terms of wires per unit weight, the costs of processing aimed at reducing the conductor diameter of the wires increase with reduced diameter.)

When the number of twisted conductor wires is two, the twisted state is unstable, uniform electrical characteristics are not obtained in the lengthwise direction, and a pleasing outward appearance is difficult to obtain. When four to six conductor wires are used, it is difficult to obtain voids sufficient to contribute to improved electrical characteristics.

In the coaxial cable 1, the adhesive force between the central conductor 2 and the insulation 3 is one third or less the tensile strength of the central conductor 2. The tensile strength of the central conductor 2 varies with the cross-sectional area even when conductors of the same material are used, but as an example, in a case where the tensile strength of the central conductor 2 is 2.26 N, the adhesive force between the central conductor 2 and the insulation 3 is required to be 0.75 N or less.

Figure 2:
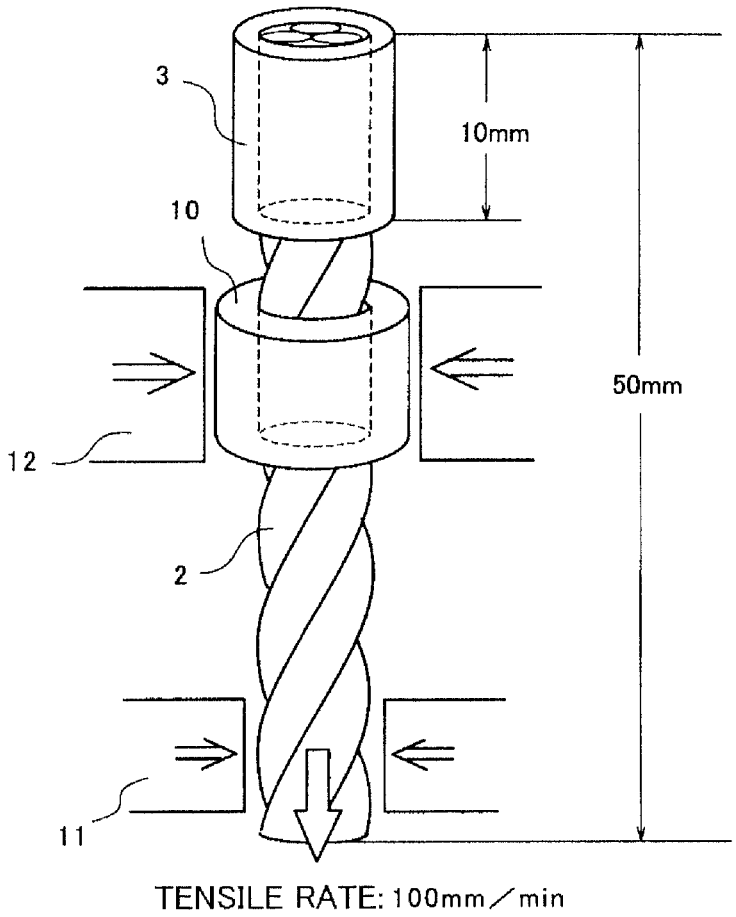
FIG. 2 is a conceptual view illustrating a method for measuring adhesive force.

FIG. 2 is a conceptual view illustrating a method for measuring the adhesive force between the central conductor 2 and the insulation 3. The adhesive force is measured in the manner described below.

(1) The jacket 5 and the outer conductor 4 are removed and 50 mm of the insulation 3 is exposed on an end part of the coaxial cable 1 for use as a sample for measurement.

(2) 40 mm of the end part of the exposed insulation is removed, and 40 mm of the central conductor is exposed.

(3) The insulation 3 and the central conductor 2 are cut away from the coaxial cable 1 at a position 50 mm from the tip of the central conductor 2, and are used as a measurement sample. In the measurement sample, the central conductor 2 is covered by the insulation 3 over a distance of 10 mm.

(4) The central conductor 2 is passed through a die 10 whose opening has a diameter larger than that of the central conductor 2 and smaller than that of the insulation 3.

(5) The central conductor 2 is held by a clamp member 11, the die 10 is held and securely immobilized by a clamp member 12, and the central conductor 2 is pulled 10 mm at a speed of 100 mm/min so that the central conductor 2 is withdrawn from the insulation 3. At this point, the withdrawal force (in units N) of the central conductor 2 is measured, and the average value thereof is regarded as the adhesive force.

Figure 3:
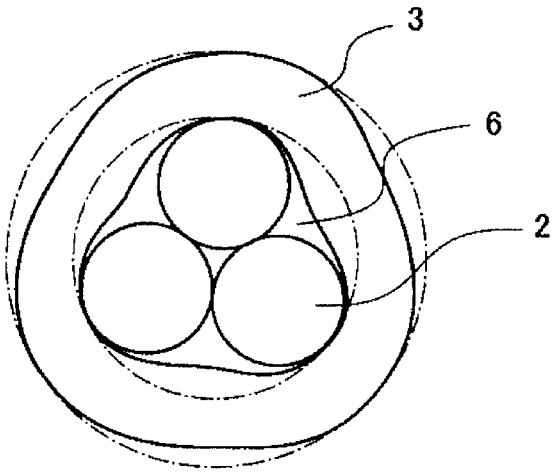
FIG. 3 is a view for illustrating the effects of adhesive force, and is a cross-sectional view of parts composed of the central conductor and insulation of the coaxial cable.

FIG. 3 is a view for illustrating the effects of adhesive force, and is a cross-sectional view of parts composed of the central conductor 2 and the insulation 3 of the coaxial cable. When the adhesive force between the central conductor 2 and the insulation 3 is great, the insulation 3 falls out of the circular shape shown by the dot-dash line and sinks into the crevices of the central conductor 2. In this case, the voids 6 between the central conductor 2 and the insulation 3 are made smaller, and the electrostatic capacitance therefore increases and the electrical characteristics decline. When the coaxial cable is bent, the central conductor 2 is squeezed by the insulation 3 with great force, and therefore repeated bending readily causes breakage, and the mechanical characteristics (bending resistance) also decline. The central conductor 2 of the coaxial cable 1 is obtained by twisting together three wires, but the adhesive force between the central conductor 2 and the insulation 3 is one third or less the tensile strength of the central conductor 2, whereby the central conductor 2 has the same electrical and mechanical characteristics as a conventional seven-twist central conductor while having better productivity and reduced costs.

The adhesive force can be adjusted by adjusting the manufacturing line speed and the distance from the insulation-forming die to the cooling water. When the extruded insulation 3 is cooled slowly, the insulation 3 tends to sink into the crevices of the central conductor 2. With rapid cooling, the shape of the insulation can be stabilized before the insulation sinks into the crevices of the central conductor 2. For example, in a case where the manufacturing line speed is 100 m/min, the adhesive force can be made to be one third or less the tensile strength of the central conductor 2 by setting the distance from the forming die to the cooling water at 3 meters or less. Conversely, when the distance from the forming die to the cooling water is set at approximately 5 meters at a manufacturing line speed of 100 m/min, the adhesive force exceeds one-third the tensile strength of the central conductor 2. When the distance from the forming die to the cooling water is set between 3 and 5 meters, the adhesive force is unpredictable, being sometimes one third or less the tensile strength of the central conductor 2 and other times not.

The twist pitch of the three twisted wires of the central conductor 2 is preferably between 11 and 16 times the outside diameter of the three twisted wires. It is possible to make the bending resistance particularly favorable when the twist pitch is in this range. Moreover, when the insulation 3 is removed and the central conductor 2 exposed in a case where a terminal of the coaxial cable is processed (provided with a connector or the like), the central conductor 2 is readily processed without unraveling.

Silver-copper alloy wires containing 0.5 to 2.2% silver are preferably used for the conductor wires of the central conductor 2. Using these silver-copper alloy wires makes it possible for the tensile strength of the central conductor 2 to be 900 MPa or above, and the electrical resistivity of the central conductor 2 to be in the particularly favorable range of 70 to 85%. Whether the central conductor is three twists or seven twists, the bending resistance will somewhat decrease when the silver content of the central conductor 2 is less than 0.5%, and signal attenuation will somewhat decrease when the silver content exceeds 3.0%.

The insulation 3 is formed by extrusion molding of tetrafluoroethylene-fluoro (alkyl vinyl ether) copolymer (PFA), tetrafluoroethylene-hexafluoropropylene copolymer (FEP), or another fluororesin material. In the coaxial cable 1, it is necessary to make the insulation thinner than in a case where the central conductor is seven twists, and therefore it is preferable for the extruded fluororesin material to have a fluidity, expressed by a melt flow rate (MFR), of 40 g/10 min or greater at 372° C. and 5 kg, the draw down ratio to be made large, and the insulation to be made thin.

Annealed copper wire, copper alloy wire, and other normally used conductors can be used in the outer conductor 4. The same conductors as the conductor wires used in the central conductor 2 can be used, and can be made into a spiral shielding on the external surface of the insulation 3. However, the diameter of the conductor wires in the coaxial cable 1 is somewhat large because the central conductor 2 is formed by three twisted wires. It is accordingly possible to use outer conductors having a somewhat smaller diameter than the conductor wires of the central conductor 2, reducing the diameter of the cable.

The jacket 5 can be formed by extrusion molding of the abovementioned PFA, FEP, or another fluororesin material. The fluororesin material used in the jacket 5 also preferably has an MFR of 40 g/10 min or greater. Alternatively, the jacket 5 may also be formed by wrapping polyester tape, polyolefin tape, or the like.

The table shows the results of comparing examples (Examples 1 and 2) of the coaxial cable according to the present invention with a reference example and a comparative example with regard to the mechanical characteristics (bending resistance), electrical characteristics (attenuation and electrostatic capacitance), and processability. Here, the coaxial cable of the reference example includes a central conductor composed of seven twisted wires and provide with approximately the same cross-sectional area as those in the examples. The coaxial cable of the comparative example includes a central conductor composed of three twisted wires, wherein the adhesive force exceeds one third the tensile strength of the central conductor.

TABLE

| | | Example 1 | Example 2 | Reference example | Comparative example |
|---|---|---|---|---|---|
| Central conductor | Number of wires | 3 | 3 | 7 | 3 |
| | Wire diameter (mm) | 0.04 | 0.04 | 0.025 | 0.04 |
| (Twist pitch of conductor)/(Diameter of central conductor) | | 11 | 16 | 14 | 14 |
| (Adhesive force)/(Tensile strength of central conductor) | | ⅓ or less | ⅓ or less | ⅓ or less | exceeds ⅓ |
| Mechanical characteristics (R = 1 mm) | | Good | Good | Good | Fair |
| Electrical characteristics | Attenuation (10 MHz) (dB/m) | Good | Good | Good | Good |
| | Electrostatic capacitance (1 kHz) | Good | Good | Good | Fair |
| Processability | | Good | Good | Good | Fair |

In the case of the examples and the comparative example, the cross-sectional area of the central conductor is 0.00377 $mm^2$ (corresponds to AWG #42), and the diameter of the circle circumscribing the central conductor (the outside diameter of the twisted wires) is 0.086 mm. In the examples, the insulation is drawn down by extrusion molding so as to make the outside diameter 0.18 mm. Tin-plated annealed copper wire having an outside diameter of 0.03 mm is made into a spiral shielding on the outside of the insulation and acts as an outer conductor. When the external surface of the outer conductor is covered by PFA to a thickness of 0.03 mm, a small-diameter coaxial cable having an outside diameter of approximately 0.30 mm is obtained. In Example 1, the twist pitch of the central conductor is 11 times the diameter of the central conductor, and in Example 2, the twist pitch of the central conductor is 16 times the diameter. In both Example 1 and Example 2, the tensile strength of the central conductor is 3.39 N, and the adhesive force is one third (1.13 N) or less that value.

The cross-sectional area of the voids between the central conductor and the insulation is set to 0.002 $mm^2$ by adjusting the drawdown ratio, the extrusion pressure of the resin, and the position of the tip of the nipple of the forming die. In this case, the volume of the voids per meter of cable length is 1.936 $mm^3$ in Example 1, and 1.954 $mm^3$ in Example 2. In Example 1, the ratio of the volume of the voids with respect to the volume of the insulation is 33.3%. In Example 2, the ratio of the volume of the voids with respect to the volume of the insulation is 33.6%. Wire containing 0.5 to 2.2% silver was used in the central conductor of the examples.

In the reference example, the cross-sectional areal of the central conductor is 0.00344 $mm^2$, and the outside diameter of the twisted wires is 0.075 mm. In this case, the insulation is extruded so as to make the outside diameter 0.18 mm. Tin-plated annealed copper wire having an outside diameter of 0.03 mm is made into a spiral shielding on the outside of the insulation and acts as an outer conductor. When the external surface of the outer conductor is covered by PFA to a thickness of 0.03 mm, a small-diameter coaxial cable having an outside diameter of approximately 0.30 mm is obtained.

In the reference example, the cross-sectional area of the voids between the central conductor and the insulation is set to 0.0008 $mm^2$ by adjusting the drawdown ratio, the extrusion pressure of the resin, and the position of the tip of the nipple of the forming die. In the seven-twist central conductor, wire whose silver content ranges from 0.5 to 2.2% was used.

To evaluate the mechanical characteristics, a coaxial cable was repeatedly flexed ±90° from a linearly extended state at a bend radius of 1 mm, and the number of repetitions before the central conductor broke was measured. When the number of repetitions was between 12,000 and 20,000, a "fair" evaluation was given, and when the number of repetitions was greater than 20,000, a "good" evaluation was given. The attenuation was measured for a 10 MHz signal. The attenuation was evaluated as "good" when 0.6 dB/m or less, and "fair" when in a range of 0.6 dB/m to 1.0 dB/m. An AC voltage of 1 KHz was applied to the coaxial cable being measured, and an LCR meter was used to measure the electrostatic capacitance. The electrostatic capacitance was evaluated as "good" when 110 pF/m or less, and "fair" when in a range of 110 pF/m to 120 pF/m. To evaluate the processability, the percentage of defectiveness due to unraveling of the central conductor was measured when the jacket and outer conductor were removed from the terminal portion of the coaxial cable and 10 mm of insulation was then further removed to expose the central conductor. When the percentage of defectiveness was 5% or less, a "good" evaluation was given, and when the percentage was in a range of 5% to 10%, a "fair" evaluation was given.

The results of the evaluations were "good" for the mechanical characteristics, electrical characteristics, and processability in the coaxial cables of Example 1, Example 2, and the reference example. Specifically, it is possible to obtain a small-diameter coaxial cable having the same electrical characteristics and mechanical characteristics as for a seven-twist wire by twisting three wires together to form the central conductor and making the adhesive force between the central conductor and the insulation one third or less the tensile strength of the central conductor. In this case, since large-diameter conductor wires can be used in the central conductor, the costs associated with a coaxial cable comprising a three-twist central conductor are affordable.

In the comparative example, the mechanical characteristics, electrostatic capacitance, and processability were "fair." The reason for this is considered to be as follows. With a three-twist wire, the adhesive force between the central conductor and the insulation is greater than one third the tensile force of the central conductor because the insulation sinks somewhat into the crevices of the twisting of the central conductor. Since this is the case, the force required to flex the coaxial cable increases. It is believed that a load is applied to the conductors and breakage more readily occurs in proportion to the increase. It is also believed that the electrostatic capacitance increases because of the smaller voids between the central conductor and the insulation. It is further believed that with a large adhesive force, the force applied to the central conductor increases when the insulation is removed and the central conductor exposed, and the central conductor readily unravels, causing the percentage of defectiveness to increase.

In a case where the adhesive force is one third or less the tensile strength of the central conductor and the central conductor is made of three twisted wires, the mechanical characteristics and the electrostatic capacitance were "good" when the twist pitch of the central conductor was 11 times the outside diameter of the twisted wires or more. The mechanical characteristics and the electrostatic capacitance were "fair" in a case where the twist pitch was 10.8 times the outside diameter. The processability was "good" when the twist pitch of the central conductor was 16 times the outside diameter of the twisted wires or less. The central conductor readily unraveled and the processability was fair in a case where the twist pitch was 16.2 times the outside diameter of the twisted wires. However, even when the central conductor was composed of seven twisted wires, the same results were obtained as with a three-twist central conductor when the twist pitch was less than 11 times the outside diameter and when the twist pitch was greater than 16 times the outside diameter. In other words, as long as the adhesive force between a three-twist central conductor and the insulation is one third or less the tensile strength of the central conductor, the same mechanical characteristics, electrical characteristics, and processability as in a case where the central conductor is composed of seven twisted wires can be attained regardless of the twist pitch of the central conductor.

The concentration of silver in the central conductor has an effect on the mechanical characteristics or the attenuation. As long as the silver concentration was from 0.5% to 2.2%, both the mechanical characteristics and the attenuation were "good." The mechanical characteristics were "fair" when the silver concentration of the central conductor was 0.2%; and the attenuation was "fair" when the silver concentration was 3.0%. The same results were obtained whether the central conductor was composed of three twisted wires or seven. As long as the adhesive force between a three-twist central conductor and the insulation is one third or less the tensile strength of the central conductor, the same mechanical characteristics, electrical characteristics, and processability as in a case where the central conductor is composed of seven twisted wires can be attained regardless of the silver concentration of the central conductor.

In the above-described examples, AWG 42 small-diameter coaxial cable was evaluated, but the adhesive force between the central conductor and the insulation is believed to exhibit a similar relationship in terms of the sinking of the insulation in coaxial cables thinner than AWG 40 (wherein the cross-sectional area of the central conductor is 0.005 $mm^2$ or less). Therefore, it is believed that the same evaluation results would be obtained in a coaxial cable thinner than AWG 40.

The invention claimed is:

1. A coaxial cable comprising:

a central conductor consisting of three single element twisted wires, the central conductor having an outer diameter and the three single element twisted wires having a twist pitch that is between 11 and 16 times the outer diameter of the central conductor, the central conductor having a cross-sectional area ≤0.005 $mm^2$;

a fluororesin insulation extruded on and covering the central conductor such that all of the twisted single element wires of the central conductor contact the fluororesin insulation as observed in a plane perpendicular to the longitudinal direction of the cable, the fluororesin insulation being a non-foam insulation material and voids being provided between portions of the central conductor and an inner surface of the fluororesin insulation;

an outer conductor disposed on the external periphery of the insulation; and a jacket for covering the outer conductor; wherein the adhesive force between the central conductor and the insulation and a breaking strength of the central conductor have the following relationship:

adhesive force $\leq 1/3$ breaking strength.

2. The coaxial cable according to claim 1, wherein the central conductor is a silver-copper alloy having a silver content of between 0.5 and 2.2 wt %.

* * * * *